United States Patent [19]

Antonas et al.

[11] Patent Number: 4,804,805

[45] Date of Patent: Feb. 14, 1989

[54] PROTECTED SOLDER CONNECTION AND METHOD

[75] Inventors: Adamantios Antonas, Fairlawn; Kenneth C. Day, Mansfield, both of Ohio

[73] Assignee: Therm-O-Disc, Incorporated, Mansfield, Ohio

[21] Appl. No.: 135,651

[22] Filed: Dec. 21, 1987

[51] Int. Cl.[4] ..... H01C 1/032

[52] U.S. Cl. ..... 174/52.2; 29/841; 29/856; 264/255; 264/265; 264/272.13

[58] Field of Search ..... 174/52 PE; 336/96; 338/22 R, 22 SD, 256, 257, 269, 275; 264/250, 255, 265, 272.13, 272.18, 272.19, 272.2; 228/59, 214, 222; 427/103; 29/841, 855, 856

[56] References Cited

U.S. PATENT DOCUMENTS

| | | | |
|---|---|---|---|
| 3,405,381 | 10/1968 | Zandman et al. | 174/52 PE X |
| 3,778,685 | 12/1973 | Kennedy | 174/52 PE X |
| 3,824,328 | 7/1974 | Ting et al. | 174/52 PE |
| 3,839,660 | 10/1974 | Stryker | 174/52 PE X |
| 4,001,655 | 1/1977 | Voyles et al. | 174/52 PE X |
| 4,230,754 | 10/1980 | Maher et al. | 174/52 PE X |

*Primary Examiner*—A. T. Grimley
*Assistant Examiner*—David A. Tone
*Attorney, Agent, or Firm*—Jones, Day, Reavis & Pogue

[57] ABSTRACT

Solder in a connection is kept from melting when applying an outer protective layer of high melting point plastic by first applying an inner layer of low melting point plastic.

19 Claims, 1 Drawing Sheet

PROTECTED SOLDER CONNECTION AND METHOD

BACKGROUND OF THE INVENTION

This application relates to the art of protective coatings and, more particularly, to protective coatings of plastic material applied at high temperatures. The invention is particularly applicable for encapsulation of electrical devices, and will be described with specific reference thereto. However, it will be appreciated that the invention has broader aspects and can be used in any situation where it is desired to apply high temperature plastic to a substrate while protecting such substrate against high temperatures.

Many engineered thermoplastics that provide high physical strength and chemical resistance have very high melting points. Application of such melted plastics to electrical devices can damage such devices, and melt solder used in connections. It would be desirable to have an arrangement for allowing use of the high temperature thermoplastics, while protecting electrical devices and soldered connections from direct exposure to the high temperatures of the melted plastics.

SUMMARY OF THE INVENTION

A device to be encapsulated in an outer layer of plastic material having a high melting temperature is first encapsulated in an inner layer of plastic material having a low melting temperature.

The inner layer of plastic material acts as a heat shield, and insulates the device from the heat of the outer layer.

The inner layer also acts as a lubricant for helping the material in the outer layer flow around a part and encapsulate same.

When used on solder connections, the inner layer prevents complete melting of the solder, and helps to hold the solder in place.

It is a principal object of the present invention to protect parts and connections against high temperatures from an outer layer of plastic material used to encapsulate the part or connection.

It is another object of the invention to provide an improved arrangement for encapsulating electrical parts and connections.

It is also an object of the invention to provide an encapsulating arrangement which allows the use of plastic materials having very high melting points.

It is a further object of the invention to provide an improved method for shielding soldered connections, and maintaining the integrity of same when subjected to high temperatures of melted plastics applied to the connections for protection.

DESCRIPTION OF A PREFERRED EMBODIMENT

Figure 1:
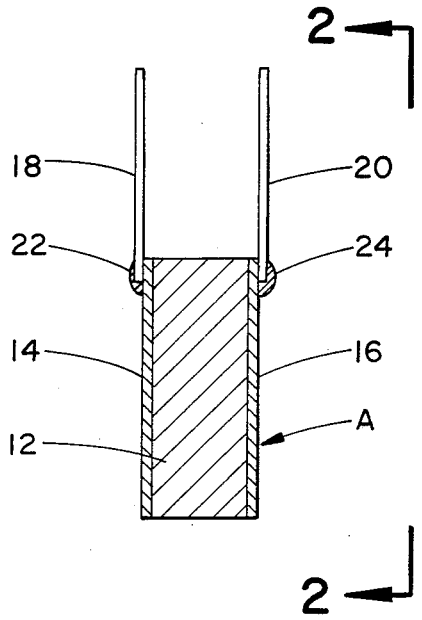
FIG. 1 is a cross-sectional elevational view of an electrical part.
Figure 2:
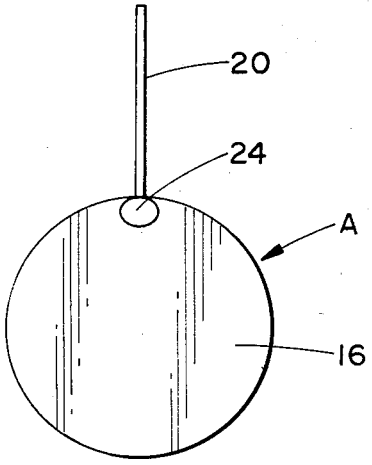
FIG. 2 is a side elevational view taken generally on line 2—2 of FIG. 1.
Figure 3:
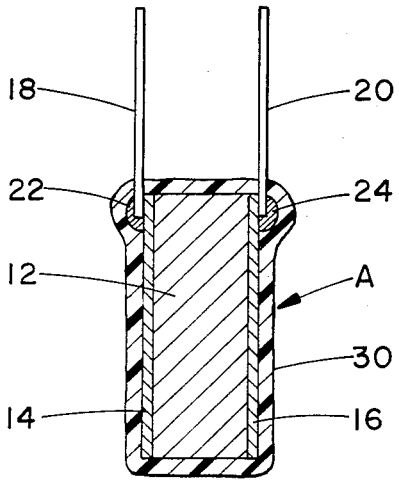
FIG. 3 is a cross-sectional view similar to FIG. 1, and showing the part encapsulated in an inner layer of plastic material.
Figure 4:
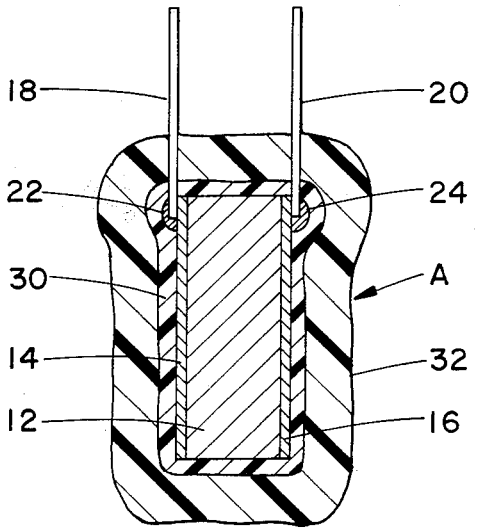
FIG. 4 is a cross-sectional elevational view similar to FIG. 3, and showing the electrical part encapsulated in an outer layer of plastic material.

Referring now to the drawing, wherein the showings are for purposes of illustrating a preferred embodiment of the invention only, and not for purposes of limiting same, FIG. 1 shows an electrical device or part A. It will be recognized that part A can be many different types of electrical parts or components, as well as many different types of non-electrical devices.

In the arrangement shown and described in this application by way of example only, part A is a thermistor having a sintered powdered metal core 12 of any suitable material, such as nickel oxide, copper oxide or titanium oxide. Opposite outer layers 14, 16, of silver oxide or the like, are sprayed or silk screened on the opposite flat faces of core 12. Wire leads 18, 20 are soldered to outer layers 14, 16 at soldered connections 22, 24.

The solder used in soldered connections 22, 24 may begin turning plastic at a temperature of around 420° F. and melt at a temperature of around 460° F. The solder will be described as having a solder melting temperature range of around 420°–460° F.

Except for the outer end portions of wire leads 18, 20, part A is completely encapsulated in an inner layer 30 of plastic material. Part A may be heated to a temperature of around 300°–325° F., and then passed through a fluidized bed of powdered plastic material which softens and fuses to part A upon engagement therewith. Part A may be heated a plurality of times and passed through a fluidized bed of plurality of times to provide an inner layer 30 thereon of a desired thickness. Thus, layer 30 comprises fused powdered particles of plastic material. The plastic material for inner layer 30 has a melting temperature range that is lower than the solder melting temperature range. The plastic material used for inner layer 30 can be of many different types and, in one arrangement, polyvinyl chloride is suitable, and has a melting temperature range of around 300°–325° F.

Subsequent to application of inner layer 30 to part A, the part is inserted in the cavity of a mold, and an outer layer 32 of a different plastic material is injection molded therearound. Except for the outer end portions of wire leads 18, 20, part A, including inner layer 30, is completely encapsulated in outer layer 32. The plastic material used for outer layer 32 is preferably one that has a very high physical strength and abrasion resistance, along with excellent chemical resistance. These properties of the plastic material used for outer layer 32 are substantially higher than the corresponding properties of the plastic material used for inner layer 30. The plastic material used for outer layer 32 may have a melting temperature range of around 680°–700° F. Thus, the melting temperature range of outer layer 32 at least approaches the solder melting temperature range, and usually substantially exceeds same.

When plastic material at a very high temperature is injection molded around a part A, the solder in connections 22, 24 may become soft or melt. Softening or melting of the solder can disrupt the connection or cause the solder to short across the leads. The physical force applied to the soldered connections by the plastic material flowing around the part can also cause the connections to break if the solder is soft.

In the arrangement of the present application, inner layer 30 insulates part A and soldered connections 22, 24 against the high temperature of the plastic used in outer layer 32. Inner layer 30 also acts as a lubricant surrounding part A for enabling outer layer 32 to flow therearound in the mold cavity. Inner layer 30 also protects soldered connections 22, 24 against high physical forces from the plastic material in outer layer 32 flowing therearound. Even if the solder in connections 22, 24 becomes soft, inner layer 30 holds the solder against flowing between the leads or moving to such an extent that a connection is broken.

The plastic material used in outer layer 32 may be of many different types. In one arrangement, polyetherimide engineering thermoplastic material has been found suitable. The thickness of the inner and outer layers may vary depending on the part being protected and the particular application. Strictly by way of example, the protective layers used on a small thermistor may be such that inner layer 30 has a thickness of around 10–20 thousandths, while outer layer 32 has a thickness of around 70–80 thousandths. While the thicknesses may vary depending upon the application, outer layer 32 is preferably substantially thicker than inner layer 30.

The plastic material forming outer layer 32 cools extremely rapidly when injected into a mold cavity. The insulating and protective action of inner layer 30 is sufficient to protect part A and its soldered connections during the extremely brief period of time that it is exposed to the high temperature material forming outer layer 32. Inner layer 30 becomes soft or at least partly melts to convert heat from outer layer 32 to energy before the heat reaches part A or the soldered connections. The majority of the heat in outer layer 32 is absorbed outwardly in the injection mold.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. An electrical device including components connected together by solder having a solder melting temperature range, said device being encapsulated in plastic material including inner and outer layers, said inner layer having an inner layer melting temperature range substantially less than said solder melting temperature range, and said outer layer having an outer layer melting temperature range substantially greater than said inner layer melting temperature range.

2. The device of claim 1 wherein said outer layer melting temperature range at least approaches said solder melting temperature range.

3. The device of claim 1 wherein said outer layer has a greater thickness than said inner layer.

4. The device of claim 1 wherein said outer layer is of a material having a substantially greater physical strength and chemical resistance than said inner layer.

5. The device of claim 1 wherein said inner layer comprises fused powder particles of plastic material.

6. The device of claim 1 wherein said outer layer is molded over said inner layer.

7. The device of claim 1 wherein said device comprises a thermistor having leads soldered thereto.

8. The device of claim 1 wherein said inner layer has a thickness of approximately 10–20 thousandths.

9. The device of claim 1 wherein said outer layer melting temperature range is at least as great as said solder melting temperature range.

10. The device of claim 1 wherein said outer layer melting temperature range is greater than said solder melting temperature range.

11. A soldered electrical connection including solder having a solder melting temperature range, plastic material enclosing said connection and including inner and outer layers, said inner layer having an inner layer melting temperature range lower than said solder melting temperature range, and said outer layer having an outer layer melting temperature range that is greater than said solder melting temperature range.

12. The connection of claim 11 wherein said inner layer has a thickness substantially less than the thickness of said outer layer.

13. The connection of claim 11 wherein both said inner and outer layers are of thermoplastic material.

14. The connection of claim 11 wherein said inner layer comprises particles of plastic powder fused to said connection.

15. The connection of claim 11 wherein said outer layer is of a material having substantially greater physical strength and chemical resistance than the material of said inner layer.

16. A method of protecting a soldered connection containing solder having a solder melting temperature range comprising the steps of applying to said connection an inner layer of plastic material having an inner layer melting temperature range lower than said solder melting temperature range, and applying over said inner layer an outer layer of plastic material having an outer layer melting temperature range substantially greater than said inner layer melting temperature range.

17. The method of claim 16 including the step of heating said connection at least approximately to said inner layer melting temperature range prior to applying said inner layer of plastic material thereto.

18. The method of claim 17 wherein said inner layer of plastic material is applied to said connection by passing said connection through a fluidized bed of powdered plastic material.

19. The method of claim 18 wherein said outer layer is injection molded onto said inner layer.

* * * * *